United States Patent [19]

Stoian

[11] 4,186,700

[45] Feb. 5, 1980

[54] LOW LEAKAGE INTEGRATOR FOR CARBURETOR CONTROL

[75] Inventor: Liviu Stoian, Arlington Heights, Ill.

[73] Assignee: Motorola, Inc., Schaumburg, Ill.

[21] Appl. No.: 939,295

[22] Filed: Sep. 1, 1978

[51] Int. Cl.[2] ..... F02B 3/00

[52] U.S. Cl. ..... 123/119 EE; 123/32 EE; 60/27 G; 123/32 EA; 328/195

[58] Field of Search ..... 123/119 EC, 32 EE, 32 EA; 60/27 G, 285; 328/195

[56] References Cited

U.S. PATENT DOCUMENTS

| | | | |
|---|---|---|---|
| 3,990,411 | 11/1976 | Oberstadt et al. | 60/276 |
| 4,096,834 | 6/1978 | Norimatsu et al. | 60/276 |
| 4,123,999 | 11/1978 | Asano | 123/32 EE |

*Primary Examiner*—Charles J. Myhre
*Assistant Examiner*—R. A. Nelli
*Attorney, Agent, or Firm*—James W. Gillman; Melvin A. Klein; Phillip H. Melamed

[57] ABSTRACT

A low leakage integrator used in a carburetor feedback control system is disclosed. The integrator comprises an operational amplifier having a feedback capacitor coupled between its output and its inverting input terminal. Input voltages are coupled through a resistor to the inverting input terminal and a pair of controllable gates are utilized to implement an integrate and hold mode of operation for the integrator while minimizing the drift of the integrator output due to leakage currents during the hold mode of the integrator.

The carburetor control system utilizes the above integrator in combination with a fuel mixture sensor and an engine position sensor to produce an output voltage related to the sensed fuel mixture. This output voltage is utilized to control a solenoid that adjusts the setting of a carburetor valve to thereby alter the carburetor fuel mixture as desired.

14 Claims, 3 Drawing Figures

LOW LEAKAGE INTEGRATOR FOR CARBURETOR CONTROL

BACKGROUND OF THE INVENTION

The present invention generally relates to integrator circuits and more particularly to the use of low leakage integrator circuits in a carburetor control system.

Integrators using an operational amplifier having a capacitor coupled between the output and inverting input terminals of the amplifier and receiving an input signal at the inverting input terminal through a resistor are well known in the prior art. Such integrators are known to produce an output voltage related to the time integral of the input voltage with respect to a reference voltage received at the non-inverting input terminal of the operational amplifier. When no voltage is applied to the inverting input terminal of the operational amplifier, then this terminal will remain at a voltage equal to the reference voltage plus an input offset voltage, and the output terminal of the operational amplifier will retain the voltage it had prior to the removal of the input voltage which had been applied to the inverting terminal. Generally, a pair of controllable gates is connected across the feedback capacitor so as to discharge this capacitor in order to reset the operational amplifier integrator.

In order to implement an integrate and hold circuit, the above operational amplifier can be combined with a series gate that selectively interrupts the application of an input voltage to the inverting input terminal of the operational amplifier. However, such gates do have finite resistances and leakages and due to their combined effect such an integrate and hold circuit would have output drift problems since during the hold mode a leakage input signal would continue to charge the feedback capacitor through the controllable series gate. While the prior art has recognized the problem caused by the leakage through a series input gate, only complex and costly solutions to this problem have been proposed. The present invention provides an inexpensive and simplified solution to the problem and also illustrates how such a low leakage integrator circuit can be utilized in a carburetor control system.

SUMMARY OF THE INVENTION

An object of the present invention is to provide an improved, inexpensive and simplified low leakage integrator circuit which overcomes the aforementioned deficiencies.

Another object of the present invention is to provide a carburetor control system in which a low leakage integrator circuit is utilized for improved performance.

In one embodiment of the present invention a low leakage integrator circuit is provided. The integrator circuit comprises: amplifier means having input, output and reference terminals, said amplifier means including structure for receiving signals at said input and reference terminals and producing at said output terminal an output signal related to the amplified input signal; capacitive feedback means connected between said input and output terminals; first controllable gate means having first and second through terminals and a control terminal, said second terminal coupled to said input terminal, said first gate means selectively providing open and short circuits between said first and second terminals in accordance with the magnitude of the signal at said control terminal; second controllable gate means having first and second through terminals and a control terminal, said first terminal of said second gate means coupled to said first terminal of said first gate means and said second terminal of said second gate means coupled to a terminal having substantially the same potential as said reference terminal, said second gate means selectively providing open and short circuits between said first and second terminals of said second gate means in accordance with the magnitude of the signal at said second gate control terminal; and control circuit means for producing first and second control signals coupled to said first gate means and second gate means control terminals, respectively, for complimentary operation of said first and second gate means, whereby with said first gate means as a short circuit an input signal can be applied through said first gate means to produce an integrated output signal at said output terminal, and with said first gate means as an open circuit the signal at said output terminal remains constant and said second gate means minimizes any leakage across said first gate means by providing a very low voltage difference across said first gate means.

The present invention also provides a carburetor control system in which a low leakage integrator as described above is utilized in conjunction with a fuel mixture sensor and an engine speed sensor. The engine speed sensor is utilized to generate the control voltages for the first and second gate means while the fuel mixture sensor provides an input voltage that is applied through a resistor to the first terminal of the first gate means. This results in providing an output voltage at the output terminal of an inverting amplifier means which serves as an input to a pulse width modulator circuit that in turn drives a solenoid which adjusts the mechanical setting of a carburetor so as to alter the fuel mixture controlled by the carburetor in response to the magnitude of the input signal applied through the resistor. In this manner the setting of the carburetor is electronically controlled in accordance with engine variables by a low leakage integrator circuit which accurately and gradually implements changes in the setting of the carburetor by periodically adjusting the carburetor setting in small increments.

BRIEF DESCRIPTION OF THE DRAWINGS

For a more complete understanding of the invention reference should made to the drawings, in which.

DESCRIPTION OF THE PREFERRED EMBODIMENT

Figure 1:
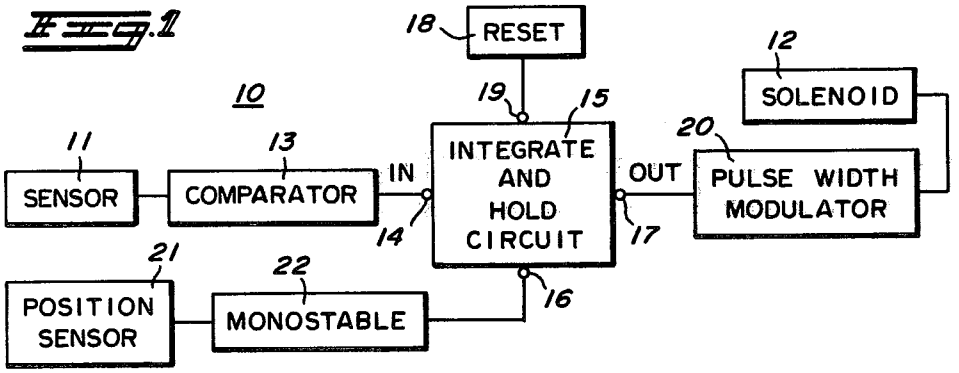
FIG. 1 is a block diagram illustrating a carburetor control system which utilizes a low leakage integrator circuit constructed according to the present invention.

FIG. 1 illustrates a carburetor control system 10 in which an oxygen sensor 11 senses the percentage of oxygen in the fuel mixture produced by a carburetor (not shown) and results in providing a drive signal for a solenoid 12 that results in mechanically adjusting the carburetor setting to provide a fuel mixture in accordance with various engine conditions.

The fuel mixture sensor 11 generally corresponds to oxygen sensors which are well known and readily available. One such sensor is the so called "lambda" sensor. The sensor 11 produces an analog output voltage related to the percentage of oxygen in a sensed mixture, and this output voltage is directly coupled as an input to a comparator circuit 13. The comparator circuit 13 compares this sensor input voltage with a reference level, either constant or determined by various engine conditions, and produces either a high or low output signal in accordance with whether the analog sensor voltage is below or above the comparator reference level. The output of the comparator 13 is therefore a digital two state signal and this output is coupled to an input terminal 14 of an integrate and hold circuit 15. The integrate and hold circuit essentially integrates, when enabled by a signal received at a control terminal 16, the signal present at the terminal 14 and produces this integrated signal as an output signal at an output terminal 17. When the integrate and hold circuit 15 is not enabled by a control signal at the terminal 16, the signal at the output terminal 17 remains constant at the magnitude which existed immediately prior to the disabling of the integrate and hold circuit 15. A reset circuit 18 is illustrated as supplying a control signal to a reset terminal 19 of the integrate and hold circuit 15. The reset circuit 18 merely comprises any circuitry which selectively produces a control signal so as to set the voltage at the output terminal 17 to some predetermined reference level. This would be desired, for example, whenever an internal combustion engine whose fuel mixture is to be controlled by the carburetor is initially started up. Any sort of pulse generating apparatus could be utilized for the reset means 18.

The output signal present at the terminal 17 is provided as an input to a pulse width modulator 20 which essentially produces a variable width pulse or a series of pulses whose width or widths are controlled by the magnitude of the signal at the terminal 17. The output of the pulse width modulator 20 is directly connected to the solenoid 12, which as previously stated controls the mechanical adjustment of a carburetor to implement a change in the fuel mixture controlled by the carburetor. An engine speed sensor 21 is also part of the carburetor control system 10 and essentially functions to produce a signal having a frequency related to the speed of the engine, and therefore related to predetermined angular positions of a crankshaft of the engine whose fuel mixture is to be controlled by the carburetor. The output of the position sensor 21 is coupled to a monostable multivibrator circuit 22 which in response to the position sensor signal produced by the sensor 21 produces constant duration control pulses which are synchronized to the engine rotation and are directly coupled to the control terminal 16 of the integrate and hold circuit 15. In this manner, the integrate and hold circuit 15 is essentially gated by constant duration engine position pulses such that the input signal present at the terminal 14 will only be integrated in small duration steps by the circuit 15 to produce small incremental changes to the output voltage at the terminal 17. In this way, the carburetor control system will still control the solenoid 12 in accordance with the magnitude of the signal produced by the sensor 11, but the rate of the changes to be implemented by the solenoid 12 will now be engine speed dependent and changes to be implemented by the solenoid 12 will now occur in small increments. This is desirable since rapidly adjusting the fuel mixture controlled by the carburetor would most probably result in over compensating for minor variations in the engine fuel mixture which would be self-corrected within one or two cycles of engine rotation. Thus improved performance of the engine is implemented by only gradually adjusting the fuel mixture controlled by the carburetor in response to any sensed deficiency in this fuel mixture. The present carburetor control system essentially provides for periodically incrementally adjusting the mechanical setting of the carburetor in response to crankshaft rotation whenever fuel mixture deficiencies are sensed.

The operation of the carburetor control system illustrated in FIG. 1 can be more readily understood by reference to the voltage waveforms shown in FIGS. 3A–3E. In these figures, the vertical axis represents the magnitude of a voltage while the horizontal axis is representative of time.

Figure 3:
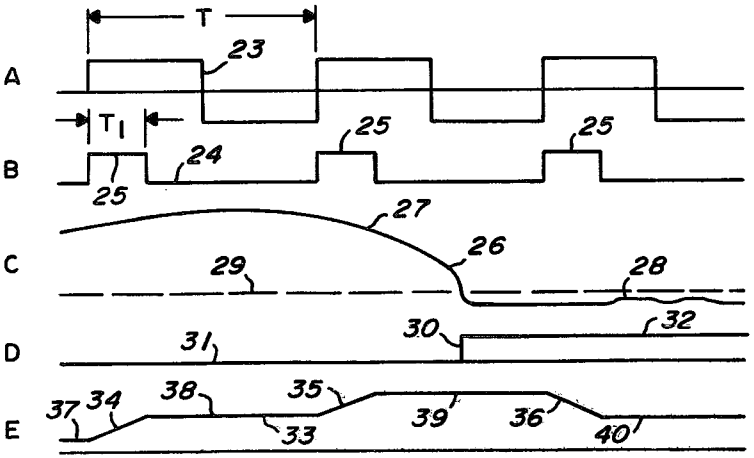
FIGS. 3A–3E are graphs which illustrate various voltage waveforms of signals produced by the carburetor control system and integrator circuit shown in FIGS. 1 and 2.

FIG. 3A illustrates a voltage waveform 23 which is representative of the output of the engine position sensor 21. Waveforms such as that shown in FIG. 3A can be readily produced either by Hall effect position sensors, or various other types of magnetic position sensors, which are used in electronic ignition systems for internal combustion engines or by the spark timing output of an electronic ignition system. Essentially the waveform 23 is merely a periodic waveform whose period T is inversely proportional to engine speed.

FIG. 3B illustrates a waveform 24 which is representative of the output of the monostable multivibrator 22. The waveform 24 is representative of a series of constant duration pulses 25 which are synchronized in their time occurrence to the waveform 23 and which have a fixed time duration $T_1$.

FIG. 3C illustrates an output voltage waveform 26 which is representative of the output signal of the fuel mixture sensor 11. FIG. 3C illustrates that at some time the sensor 11 will produce a relatively high magnitude signal corresponding to the level 27 which will indicate that the carburetor should be mechanically adjusted to decrease the ratio of fuel to oxygen which is controlled by the carburetor. At other times the sensor 11 will produce a relatively low magnitude signal corresponding to the level 28 that indicates that the carburetor should be mechanically adjusted to increase (enrich) the fuel mixture control by the carburetor. A reference level 29 is illustrated in FIG. 3C and would generally correspond to the reference level of the comparator 13 which would be utilized to compare the waveform 26 therewith to produce an input signal present at the terminal 14 and which is represented in FIG. 3D by the waveform 30. The waveform 30 basically comprises a two-state digital signal in which a high logic state corresponding to a reference level 31 indicates that the carburetor should be adjusted to decrease the fuel-to-air ratio of the sensed mixture, whereas a low logic state corresponding to the reference level 32 indicates that the carburetor mixture should be enriched to some predetermined level.

In FIG. 3E, a waveform 33 is illustrated which represents the voltage at the output terminal 17 of the integrate and hold circuit 15. The waveform 33 illustrates that during the duration of the monostable pulses 25, the integrate and hold circuit 15 will essentially integrate the signal 30 and produce ramp-like variations such as 34, 35 and 36 which will tend to either increase or decrease the magnitude of the signal 33 such that this signal magnitude will be altered so as to increment the magnitude of the signal 33 in a direction tending to make the signal 33 correspond to the signal 30. Essentially, during the periods 25, the integrate and hold circuit 15 will be enabled and the ramp portions 34–36 represent the integrated RC increase or decrease of the signal 33 during the pulses 25. When the integrate and hold circuit 15 is not enabled by the monostable pulses 25, the output of the integrate and hold circuit 15 remains constant and this operation is represented by flat portions 37–40 of the waveform 33.

By utilizing the waveform 33 to control the movement of the solenoid 12 through the pulse width modulator, and because of the closed loop type operation of the system, it is clear that only small increments of change in the setting of the carburetor controlled by the solenoid 12 will be implemented by the present system. This prevents overcompensating for short term variations in engine conditions which would indicate that large changes in the mechanical adjustment of the carburetor should be implemented. The waveforms in FIGS. 3A–3E illustrate that during the time that the magnitude of the signal 30 is at the level 31 indicating that an decrease in the fuel mixture is required, two small step increases provided by the ramps 34 and 35 are implemented so as to gradually increase the magnitude of the signal 33 that controls the setting of the mechanical adjusting of the carburetor via the solenoid 12. When the signal 30 indicates that the setting of the carburetor must now be increased due to the existence of the level 32, the integrate and hold circuit 15 again implements a gradual reduction in the magnitude of the signal 33 by the ramp step 36. Thus the present carburetor control system utilizes small step increments which occur in synchronism with engine rotation to alter the settings of the carburetor and thereby adjust the fuel mixture to an internal combustion engine.

Figure 2:
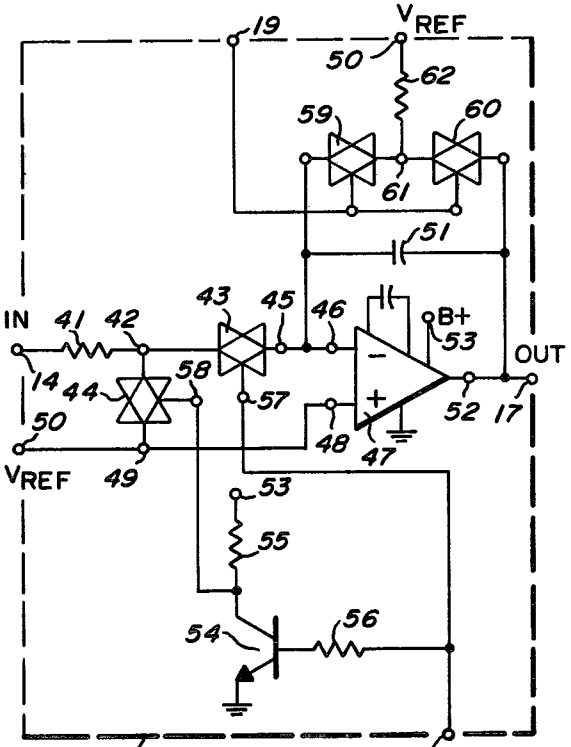
FIG. 2 is a schematic diagram illustrating the low leakage integrator circuit shown in FIG. 1.

FIG. 2 illustrates the detailed construction of the integrate and hold circuit 15 which is illustrated in block form in FIG. 1. Identical reference numbers have been utilized to indicate corresponding components. FIG. 2 illustrates how the integrate and hold circuit 15 implements a low leakage gated integrating function.

Input terminal 14 of the integrator circuit 15 is connected through a resistor 41 to a terminal 42 which serves as a first through terminal of a controllable gate 43 as well as a first through terminal of a controllable gate 44. A second through terminal 45 of the gate 43 is directly connected to an inverting input terminal 46 of an operational amplifier 47. A non-inverting input terminal 48 of the operational amplifier 47 is directly connected to a second through terminal 49 of the controllable gate 44, and the terminals 48 and 49 are directly connected to a terminal 50 at which a reference voltage $V_{ref}$ is applied. A feedback capacitor 51 is coupled between the inverting input terminal 46 and an output terminal 52 of the operational amplifier 47, and the output terminal 52 is directly connected to the output terminal 17 of the integrate and hold circuit 15.

A positive supply potential B+ is connected to a terminal 53 (shown in two locations in FIG. 2) and supplies power to the operational amplifier 47 and an inverting amplifier stage comprising an NPN transistor 54 having its emitted coupled to ground, its collector coupled to the terminal 53 through a resistor 55 and its base coupled to the control terminal 16 of the circuit 15 through a resistor 56. The control terminal 16 is also directly connected to a control terminal 57 of the first controllable gate 43 and the collector of the transistor 54 is directly connected to a control terminal 58 of the controllable gate 44. The transistor 54 essentially inverts the control signal present at the terminal 16 such that the controllable gates 43 and 44 are operated in a complimentary fashion depending upon the magnitude of the control signal present at the terminal 16.

A pair of controllable gates 59 and 60 each have a common through terminal 61 connected through a resistor 62 to the voltage reference terminal 50, and the control terminals of each of the controllable gates 59 and 60 are connected together and directly connected to the reset control terminal 19. A through terminal of the gate 59 is connected to the inverting input terminal 46 and a through terminal of the gate 60 is connected to the output terminal 52 of the operational amplifier 47. The gates 59 and 60 are simultaneously operated by the voltage at the terminal 19 so as to effectively short out the capacitor 51 and reset the integrate and hold circuit 15 by simultaneously applying the reference voltage to the terminals 46 and 52. This will result in setting the voltage at the output terminal 52 at the voltage reference level and maintaining it at that level until still another voltage is applied to the terminal 46 through the controllable gate 43.

Essentially, waveforms corresponding to those shown in FIGS. 3A–3E are generated by the carburetor control system shown in FIG. 1. With waveform 24 applied to the control terminal 16 and waveform 30 applied to the terminal 14, the waveform 33 will be created at the terminal 17 in response thereto as long as the integrate and hold circuit 15 has not been reset by the application of a positive signal at the terminal 19.

As was previously mentioned, the problem with prior art integrate and hold circuits having configurations similar to that shown in FIG. 15 is that the leakage across the series controllable gate corresponding to the gate 43 is generally substantial and results in causing the signal at the terminal 52 to drift. The reason for this is because generally a large potential exists across the gate 43 between its through terminals 42 and 45.

All of the controllable gates function similarly in that in response to control signals applied to the control terminals of these gates, the gates selectively provide short or open circuits between their through terminals. While the short circuits provided are essentially perfect short circuits (or in the worst cases their effect can be minimized by the proper selection of the resistor 41), the open circuits provided may actually represent a very high value resistor in parallel with a current source (the magnitude of the current of the current source being a function of the voltage across the gate) instead of a perfect open circuit. Thus it is likely that even when CMOS devices are used for each of the controllable gates, a significant finite resistance will exist between the through terminals when the gates are suppose to present an open circuit, and leakage across these gates would exist.

In the present invention, the controllable gate 44 is operated in a complimentary fashion with respect to the controllable gate 43 and is utilized to insure that when the gate 43 is to implement an open circuit across its through terminals 42 and 45, the gate 44 will apply a voltage to the terminal 42 to minimize the leakage produced across the gate 43. This is accomplished by having the gate 44 implement a short circuit whenever the gate 43 implements an open circuit. In the present embodiment, this results in applying the reference voltage at the terminal 50 directly to the terminal 42 when the gate 43 is to be open circuited. Since the terminal 46 will revert to substantially the reference voltage potential when the gate 43 is open, and since it is commonly known that the input terminals of an operational amplifier are maintained at almost exactly the same potential in a configuration such as that shown in FIG. 2, it is clear that almost no voltage potential will exist across the gate 43 and that therefore almost no leakage current will pass through this gate and cause drift in the voltage at the output terminal 52. This results in substantially improving the performance of the integrator circuit 15 and thereby improving the performance of the carburetor control system in which the integrator circuit 15 is utilized.

To better understand the present invention, reference should be made to the equation which appears below which expresses the relationships that exists for the integrator circuit 15 (assuming no leakage):

$$V_{out} = V_{out}(0) - \frac{1}{RC} \int_0^t (V_{in} - V_{ref})\, dt$$

where $V_{out}$ is the voltage at the terminals 17 and 52, $V_{out}(0)$ is the preceding voltage which existed at the output terminals prior to enabling the integrating circuit 15, R is the magnitude of the resistor 41, C is the magnitude of the capacitor 51, $V_{in}$ is the voltage at the terminal 14, and $V_{ref}$ is the voltage at the terminals 48–50. From the preceding equation it is clear that with the controllable gate 43 acting as a short circuit, the circuit 15 will essentially integrate the applied voltage $V_{in}$ in accordance with the magnitude of the resistor 41 and the capacitor 51. When the controllable gate 43 is an open circuit, the output voltage will be maintained at its previous value, and the controllable gate 43 will apply a potential to the terminal 42 that will result in minimizing the leakage produced across the controllable gate 43.

Preferably, all of the controllable gates 43, 44, 59 and 60 are CMOS gates which are contained on a single integrated circuit chip. These chips are readily available and represent an economical way of implementing the structure shown in FIG. 2.

It should be noted that it may be necessary to apply a resistor in parallel with the gate 43 between the terminals 42 and 45 in order to minimize integrating overshoot which is common to the type of operational amplifier integrator shown in the present embodiment. However, even with this reduction in the open circuit impedance between the terminals 42 and 45, the present invention will still implement substantially no leakage and therefore result in substantially no drift of the voltage at the output terminals 17 and 52.

It should also be noted that the terminal 61 was connected through the resistor 62 to the voltage reference terminal 50 in order to minimize any possible leakage across the controllable gates 59 and 60. Preferably, the magnitude of the reference voltage at the terminal 50 would be one-half the potential difference between the positive supply potential terminal 53 and ground since this would permit the maximum swing of the voltage at the output terminals 17 and 52.

While I have shown and described specific embodiments of this invention, further modifications and improvements will occur to those skilled in the art. All such modifications which retain the basic underlying principles disclosed and claimed herein are within the scope of this invention.

I claim:

1. A low leakage integrator circuit comprising:

amplifier means having input, output and reference terminals, said amplifier means including structure for receiving signals at said input and reference terminals and producing at said output terminal an output signal related to the amplified input signal;

capacitive feedback means connected between said input and output terminals;

first controllable gate means having first and second through terminals and a control terminal, said second terminal coupled to said input terminal, said first gate means selectively providing open and short circuits between said first and second terminals in accordance with the magnitude of the signal at said control terminal;

second controllable gate means having first and second through terminals and a control terminal, said first terminal of said second gate means coupled to said first terminal of said first gate means and said second terminal of said second gate means coupled to a terminal having substantially the same potential as said reference terminal, said second gate means selectively providing open and short circuits between said first and second terminals of said second gate means in accordance with the magnitude of the signal at said second gate means control terminal; and control circuit means for producing first and second control signals coupled to said first gate means and second gate means control terminals, respectively, for complimentary operation of said first and second gate means, whereby with said first gate means as a short circuit an input signal can be applied through said first gate means to produce an integrated output signal at said output terminal, and with said first gate means as an open circuit the signal at said output terminal remains constant and said second gate means minimizes any leakage across said first gate means by providing a very low voltage difference across said first gate means.

2. An integrator circuit according to claim 1 wherein said control means receives an input control signal and produces said first and second control signals in response thereto.

3. An integrator circuit according to claims 1 or 2 wherein said amplifier means is an operational amplifier, said input terminal corresponds to an inverting input terminal of said operational amplifier, said reference terminal corresponds to a non-inverting input terminal of said operational amplifier and said output terminal corresponds to an output terminal of said operational amplifier.

4. An integrator circuit according to claim 3 wherein said second gate means has its first terminal directly connected to said first terminal of said first gate means and its second terminal directly connected to said reference terminal.

5. An integrator circuit according to claim 4 which includes reset means for selectively providing a low impedance discharge path in parallel with said capacitive feedback means.

6. An integrator circuit according to claim 5 wherein said reset means comprises two CMOS switches and said first and second gate means also each comprise a CMOS switch, the four CMOS switches being provided on a single integrated circuit.

7. An integrator circuit according to claim 6 wherein said first control signal is the inverse of said second control signal and one of said first and second control signals is identical to said input control signal.

8. An integrator circuit according to claim 3 which includes a resistor having a first end adaptable for receiving a voltage input and a second end coupled to said first terminal of said first gate means, wherein said integrator circuit functions to provide a signal at said output terminal which is the time integral of the quantity of the difference between the voltage at said first resistor terminal and the reference voltage, the time integral being divided by the product of the magnitude of the resistor and the magnitude of the capacitance provided by the capacitive feedback means.

9. A carburetor control system comprising:

adjustable carburetor means for controlling the air to fuel mixture for an engine;

sensor means for providing an input signal at a terminal wherein the magnitude of said input signal is related to the percentage of oxygen mixed with fuel by said carburetor;

a low leakage integrator circuit comprising:

amplifier means having input, output and reference terminals, said amplifier means including structure for receiving signals at said input and reference terminals and producing at said output terminal an output signal related to the amplified input signal;

capacitive feedback means connected between said input and output terminals;

first controllable gate means having first and second through terminals and a control terminal, said second terminal coupled to said input terminal, said first gate means selectively providing open and short circuits between said first and second terminals in accordance with the magnitude of the signal at said control terminal;

second controllable gate means having first and second through terminals and a control terminal, said first terminal of said second gate means coupled to said first terminal of said first gate means and said second terminal of said second gate means coupled to a terminal having substantially the same potential as said reference terminal, said second gate means selectively providing open and short circuits between said first and second terminals of said second gate means in accordance with the magnitude of the signal at said second gate means control terminal; and control circuit means for producing first and second control signals coupled to said first gate means and second gate means control terminals, respectively, for complimentary operation of said first and second gate means, whereby with said first gate means as a short circuit an input signal can be applied through said first gate means to produce an integrated output signal at said output terminal, and with said first gate means as an open circuit the signal at said output terminal remains constant and said second gate means minimizes any leakage across said first gate means by providing a very low voltage difference across said first gate means;

means coupling said sensor input signal to said amplifier means input terminal; and means coupled to said amplifier means output terminal and said carburetor means for controlling the mechanical setting of said carburetor to adjust the carburetor controlled fuel mixture in accordance with the magnitude of the signal at said output terminal.

10. A carburetor control system according to claim 9 wherein said control circuit means receives an input control signal and produces said first and second control signals in response thereto.

11. A carburetor control system according to claims 9 or 10 wherein said amplifier means is an operational amplifier, said input terminal corresponds to an inverting input terminal of said operational amplifier, said reference terminal corresponds to a non-inverting input terminal of said operational amplifier and said output terminal corresponds to an output terminal of said operational amplifier.

12. A carburetor control system according to claim 11 wherein said second gate means has its first terminal directly connected to said first terminal of said first gate means and its second terminal directly connected to said reference terminal.

13. A carburetor control system according to claim 11 in which said sensor coupling means includes a resistor having a first end coupled to said sensor input signal and a second end coupled to said first terminal of said first gate means, wherein said integrator circuit functions to provide a signal at said output terminal which is the time integral of the quantity of the difference between the voltage at said first resistor terminal and the reference voltage, the time integral being divided by the product of the magnitude of the resistor and the magnitude of the capacitance provided by the capacitive feedback means.

14. A carburetor control system according to claim 10 which includes an engine position sensor means for producing said input control signal in accordance with engine rotation.

* * * * *

Disclaimer 4,186,700.—*Liviu Stoian*, Arlington Heights, Ill. LOW LEAKAGE INTEGRATOR FOR CARBURETOR CONTROL. Patent dated Feb. 5, 1980. Disclaimer filed Dec. 8, 1980, by the assignee, *Motorola, Inc.*

Hereby enters this disclaimer to claims 1, 2, 3 and 8 of said patent.

[*Official Gazette February 24, 1981.*]